US010796675B1

(12) United States Patent
Turney

(10) Patent No.: US 10,796,675 B1
(45) Date of Patent: Oct. 6, 2020

(54) PIANO FOOTED SHEET MUSIC HOLDER

(71) Applicant: Marty H. Turney, Sommerville, AL (US)

(72) Inventor: Marty H. Turney, Sommerville, AL (US)

( * ) Notice: Subject to any disclaimer, the term of this patent is extended or adjusted under 35 U.S.C. 154(b) by 0 days.

(21) Appl. No.: 16/741,452

(22) Filed: Jan. 13, 2020

(51) Int. Cl.
*G10G 7/00* (2006.01)
*G10C 3/00* (2019.01)

(52) U.S. Cl.
CPC ..... *G10G 7/00* (2013.01); *G10C 3/00* (2013.01)

(58) Field of Classification Search
CPC ..... G10G 7/00; G10C 3/00
See application file for complete search history.

(56) References Cited

U.S. PATENT DOCUMENTS 556,064 A * 3/1896 Pepper ..... G10C 3/02 84/180
1,406,872 A 2/1922 Johnson
2,105,739 A * 1/1938 Jacobs ..... G10C 3/02 84/180
2,917,965 A * 12/1959 Reed ..... G10G 7/00 84/472
3,544,056 A * 12/1970 Berquist ..... G10G 7/00 248/443
3,946,980 A * 3/1976 Tamarkin ..... A47B 23/004 248/443
4,275,863 A 6/1981 Hartman
4,832,302 A 5/1989 Anderson et al.
6,491,277 B1 * 12/2002 Chappell ..... G10G 7/00 248/459
7,009,095 B2 * 3/2006 Ichikawa ..... G10C 3/02 84/177
7,544,877 B2 * 6/2009 Saito ..... G10C 3/00 84/453
7,576,272 B2 * 8/2009 Houfek ..... G10G 7/00 84/180
7,723,595 B2 * 5/2010 Dunlop ..... G10G 7/00 84/421
8,785,756 B2 * 7/2014 Murozono ..... A47B 23/004 84/453
9,196,229 B1 * 11/2015 Burton ..... A47B 19/00
9,241,563 B2 * 1/2016 Katz ..... G10C 3/00
9,468,291 B2 * 10/2016 Nilsen ..... A47B 23/004
2006/0175523 A1 8/2006 Tai
2009/0000457 A1 * 1/2009 Dunlop ..... G10G 7/00 84/329

* cited by examiner

*Primary Examiner* — Robert W Horn
(74) *Attorney, Agent, or Firm* — Cynthia R. Wright

(57) ABSTRACT

A piano sheet music holder displays sheet music while being mounted within the piano cabinet. The piano sheet music holder comprises a sheet music holder with at least one footed projection extending from the sheet music holder via an arm, wherein the arm is shaped to fit within the piano cabinet so that the footed projection anchors the sheet music holder onto the front of the piano. The footed projection cantilevers the sheet music holder by pressing upward against the music rack and/or the music shelf of the piano.

7 Claims, 8 Drawing Sheets

PIANO FOOTED SHEET MUSIC HOLDER

CROSS-REFERENCE TO RELATED APPLICATIONS

This application does not claim priority to any previously-filed US Application.

DISCLOSURE REGARDING PRIOR DISCLOSURES BY THE INVENTOR OR A JOINT INVENTOR

The inventor has not disclosed this invention prior to the filing of this non provisional application.

BACKGROUND OF THE INVENTION

(1) Field of the Invention

This invention relates generally to musical instruments and accessories, and more specifically to an apparatus for holding and displaying sheet music or other material on a piano so that a user can display the sheet music while playing the piano.

(2) Disclosure of the Prior Art

Currently, pianos include a built-in sheet music holder. A user lifts the lid of the piano, moves the music rack within the piano cabinet, lifts the built-in sheet music holder, and rests the built-in sheet music holder so that it is securely upright. A number sheet music holders, are know in the industry. But, these sheet music holders are not especially adapted to be installed onto a piano. R. G. Johnson (U.S. Pat. No. 1,406,872) discloses a sheet music holder that can be used while the musician is marching in a band while playing music. This device could not be mounted onto a piano.

Jonathan Tai (US 2006/0175523 A1) discloses a sheet music holder that folds into a compact into a compact size so that the holder may easily be transported by a user. This device may be used by musicians playing a variety of instruments. This device could not be used by a piano player because the piano player would be forced to look away from the piano keys while playing making it more difficult to play the piano. Anderson et al. (U.S. Pat. No. 4,832,302) discloses a sheet music holder mounted onto a guitar allowing a user to read the sheet music placed thereon while playing the guitar. This device is specially adapted to be used on a guitar and could not be used by a piano player.

BRIEF SUMMARY OF THE INVENTION

This device comprises a sheet music holder modified to be installed onto a piano. Although pianos are sold with a sheet music holder built into the cabinet of the piano, the piano user is required to have the lid of the piano open to use the built in sheet music holder. This device allows a user to display sheet music so that a user can play the piano with the piano lid down, which reduces the volume of the music produced by the piano. A reduction of the noise level of the music produced allows a user to play his piano in an apartment or other areas with noise limitations. A device is needed that will allow a piano player to have access to a sheet music holder while playing the piano with the lid or lids placed in a down position closing the piano cabinet.

A user manipulating the lid of the piano and the fall board may experience bumped and bruised fingers, hands, and elbows, and muscle strain from lifting the piano lid or lids and from sliding and manipulating the music rack and the built-in music shelf. A device is needed that will allow a piano player to have access to a sheet music holder without having to manipulate and move the music rack and the built-in music shelf.

BRIEF DESCRIPTION OF THE DRAWINGS

The invention is described in detail below with reference to the appended drawings.

FIG. 1 shows the device installed on a grand piano with the large lid of the piano raised and the small lid removed.

FIG. 2 depicts the Piano Footed Sheet Music Holder installed on a grand piano with the small lid raised.

FIG. 3 depicts FIG. 1 with the small lid closed and partially cut away.

FIG. 4 shows a rear view of the device.

FIG. 5 illustrates and exploded view of FIG. 4.

FIG. 6 illustrates a front view of the device.

FIG. 7 is an exploded, front view of the device with two footed projections detached.

FIG. 8 depicts a mid-sectional view of the device installed upon a piano.

DETAILED DESCRIPTION OF THE INVENTION

Figure 1:
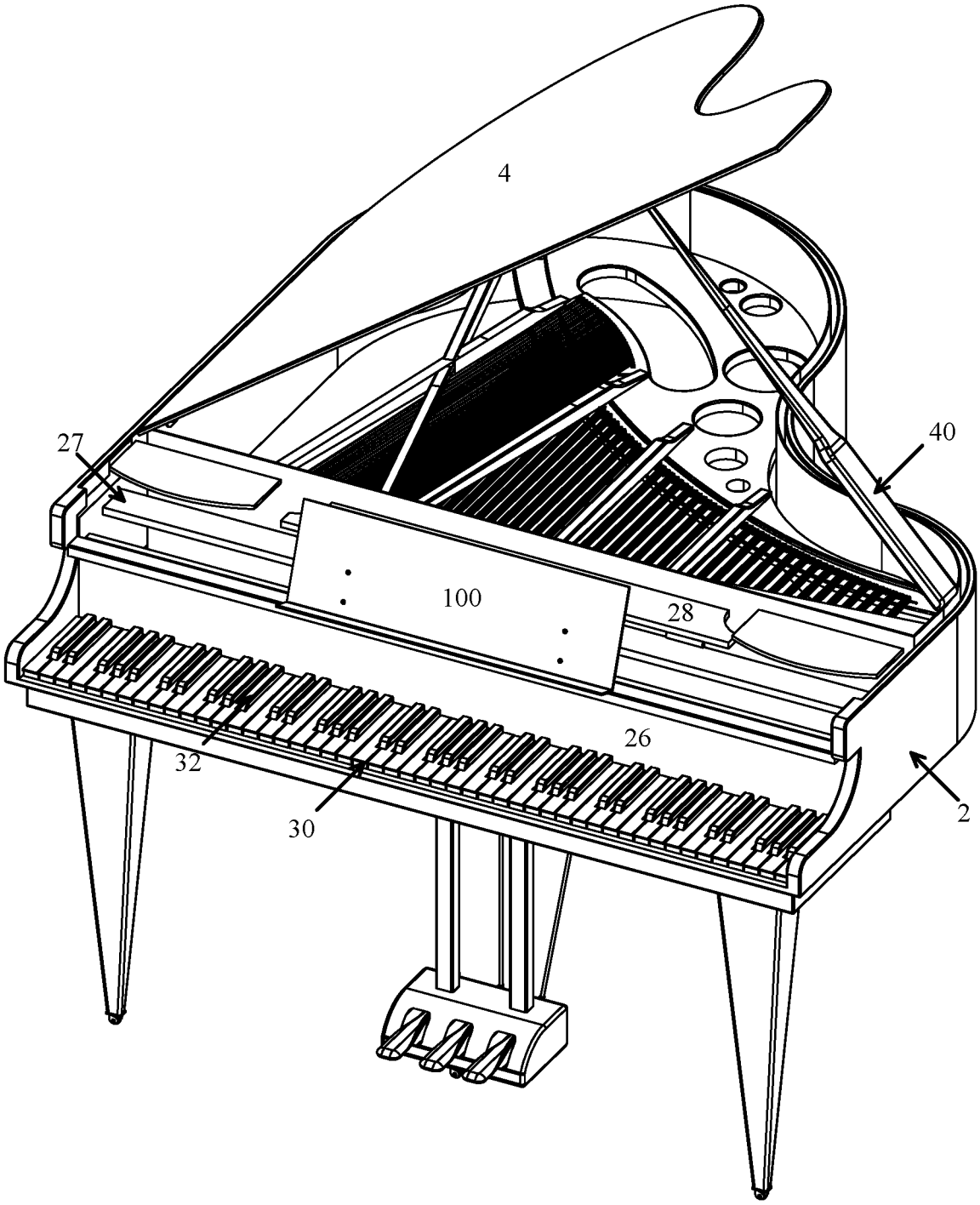
FIGS. 1 through 8 depict the Piano Footed Sheet Music Holder. In the Figures.

While this invention is susceptible of embodiment in many different forms, there are shown in the drawings and will herein be described in detail, several embodiments with the understanding that the present disclosure should be considered as an exemplification of the principles of the invention and is not intended to limit the invention to the embodiments so illustrated. Further, to the extent that any numerical values or other specifics of materials, etc., are provided herein, they are to be construed as exemplifications of the inventions herein, and the inventions are not to be considered as limited thereto.

The following description and drawings are illustrative and are not to be construed as limiting. Numerous specific details are described to provide a thorough understanding of the disclosure. However, in certain instances, well-known or conventional details are not described in order to avoid obscuring the description. References to one, or an embodiment in the present disclosure, can be, but not necessarily, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments, but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same term can be said in more than one way.

Consequently, alternative language and synonyms may be used for any one or more of the terms discussed herein, or is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

FIG. 1 depicts the Piano Footed Sheet Music Holder installed on a grand piano with the large lid of the piano raised and the small lid removed. The cabinet 2 is the structure that supports the lid 4, keys 30, black keys 32, and encloses the components responsible for producing music. The front surface of panel 100 of the sheet music holder is flat and smooth allowing sheet music to be placed in an upright position so that a player may read it. Fall board 26 is shown up so that the keys 30 and 32 are visible. The built-in sheet music holder 28 is left in the down position while the device is installed. Music rack 27 has not been moved to support built-in sheet music holder 28. Although lid 4 is shown propped open via support 40, lid 4 may be either open or closed while the Piano Footed Sheet Music Holder is installed.

Figure 2:
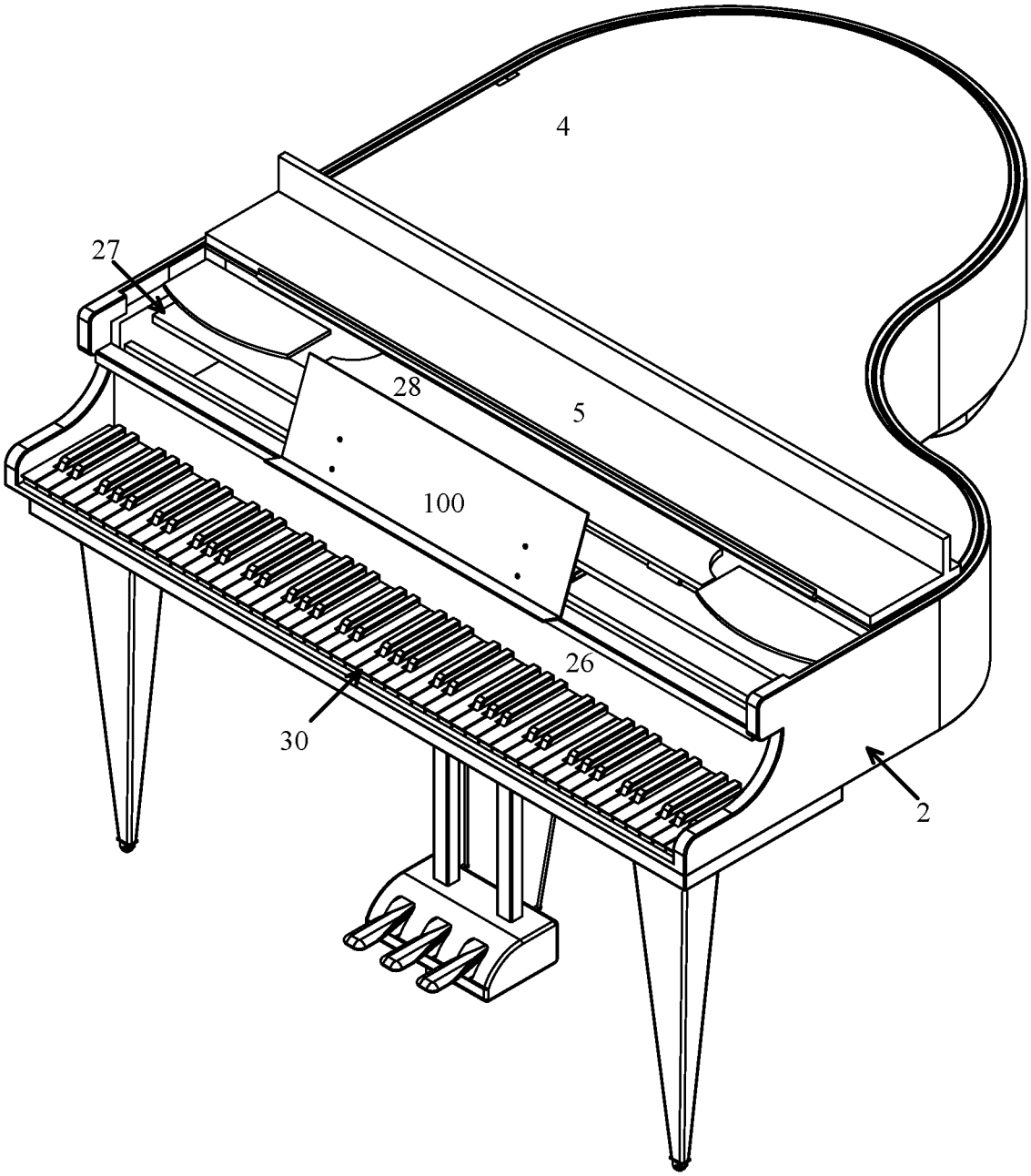

FIG. 2 depicts the Piano Footed Sheet Music Holder installed on a grand piano with the small lid raised. Small lid 5 is shown in the open position resting on top of lid 4. Some pianos may have a single lid (not shown). The front surface of panel 100 of the device herein is installed, fall board 26 is open allowing a user to access piano keys 30. The piano may be played when the small lid of the cabinet 2 is open and the lid 4 is closed. This will substantially reduce the volume of music produced when the piano is played. Additionally, the tone of the music produced by the piano changes when small lid 5 is open and lid 4 closed. Some users may prefer this tone for their music. And, because the piano player did not have to raise the lid to access the built-in sheet music holder 28, the player did not subject himself or herself to the risk of elbow and arm muscle strain from lifting the weight of lid 4, which is usually solid hardwood. The built-in sheet music holder 28 is secured and music rack 27 is in the closed position. Because the piano player did not have to manipulate the built-in sheet music holder 28 and the music rack 27 in order to play, the likelihood of injuries to a user's arms, hands, and elbows is reduced.

An additional benefit of the invention herein is that this device locates the sheet music placed onto the Piano Footed Sheet Music Holder closer to the piano player than sheet music placed onto the built-in sheet music holder making it easier for those needing corrective lenses to see the sheet music.

Figure 3:
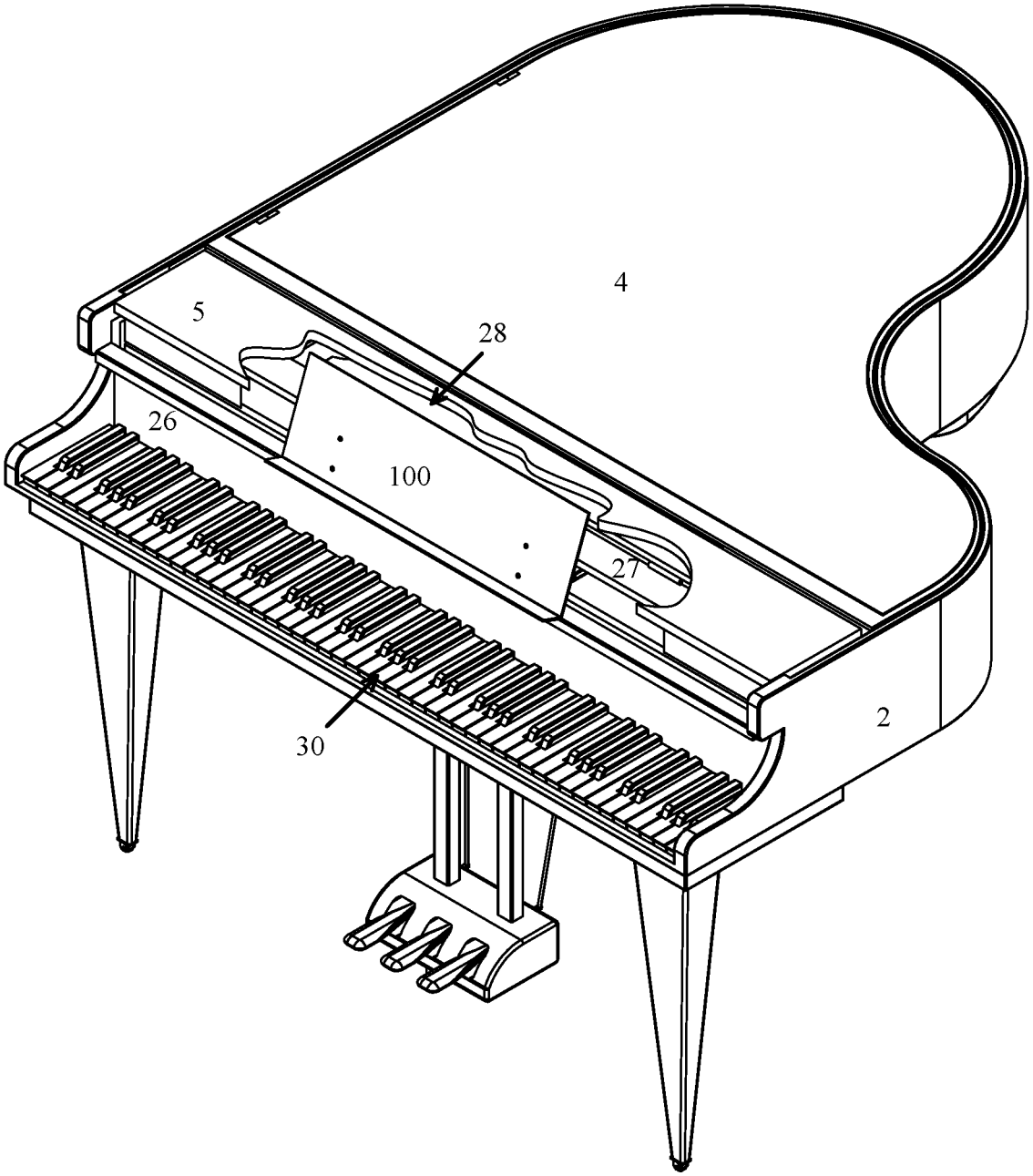

FIG. 3 is identical to FIG. 2 except small lid 5 is shown closed in FIG. 3. Small lid 5 is shown partially cut away. Using the Piano Footed Sheet Music Holder with both small lid 5 and lid 4 closed will produce a noise level of music substantially less that when both small lid 5 and lid 4 are both closed, and when small lid 5 is open and lid 4 is closed. The tone of music produced when both small lid 5 and lid 4 are closed will be different than when both small lid 5 and lid 4 are both closed, and when small lid 5 is open and lid 4 is closed. This position reduces or eliminates dust and dirt from entering the internal cavity of cabinet 2.

Figure 4:
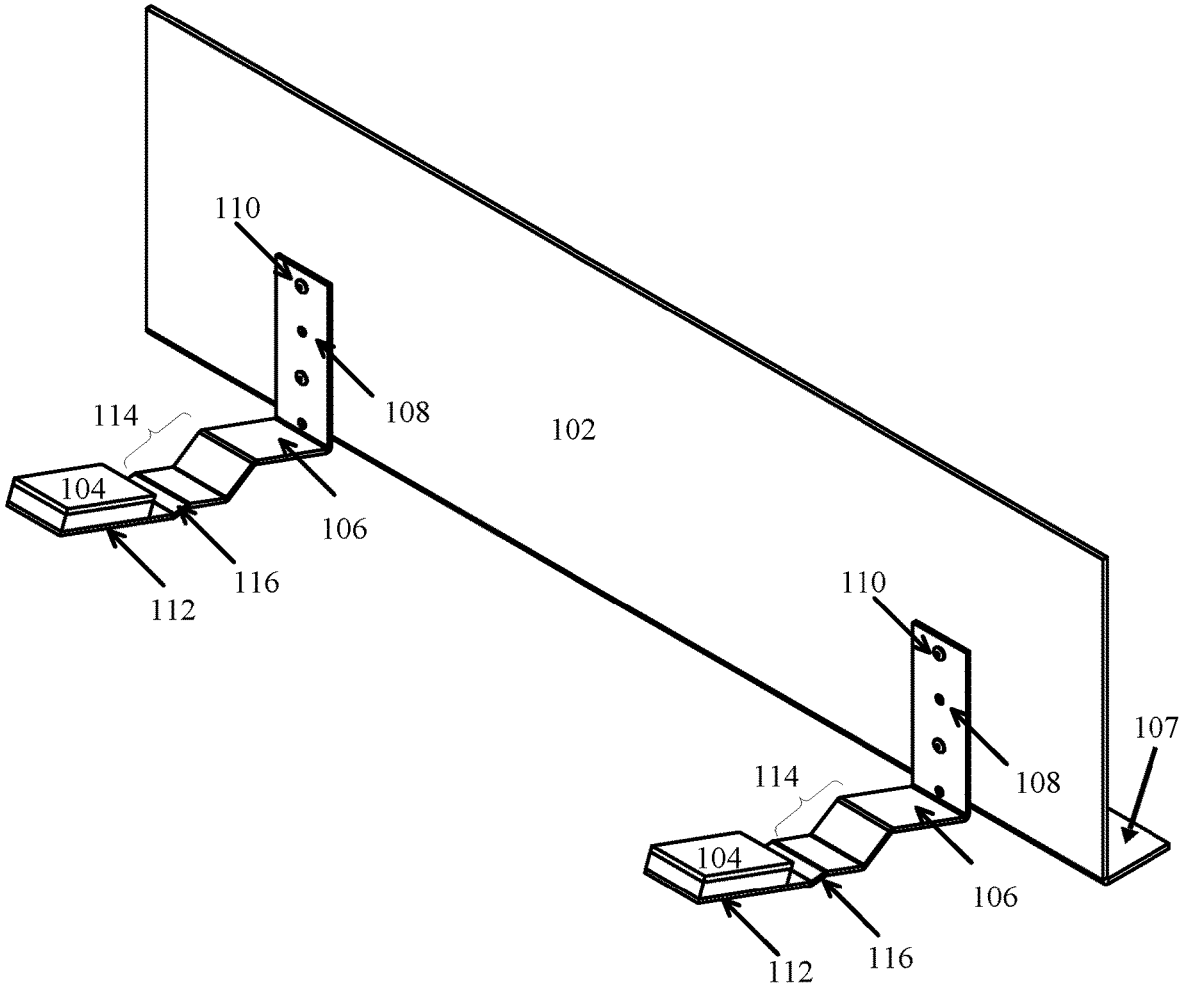

FIG. 4 shows a rear view of the device. The rear surface 102 of panel 100 of the Piano Footed Sheet Music Holder is shown. The Piano Footed Sheet Music Holder may be formed of aluminum, steel, wood, or any suitable material that is strong enough to hold sheet music and to be anchored within the piano. Shelf 107 may be utilized to place or stack sheet music. One or more arm mounting plates 108 may be anchored onto the rear surface 102 via one or more mounting screws 110. Arm 106 connects arm mounting plate 108 to arm angle 114. Arm 106 extends above fall board 26 (shown in FIG. 8). Arm angle 114 is formed to fit below and around small lid 5 (shown in FIG. 8). Arm bend 116 connects arm angle 114 to foot 112. Foot 112 may be coupled to nonskid pad 104. Foot 112 may rest below built-in sheet music holder 28 pressing against it cantilevering the weight of panel 100 against built-in sheet music holder 28.

Figure 5:
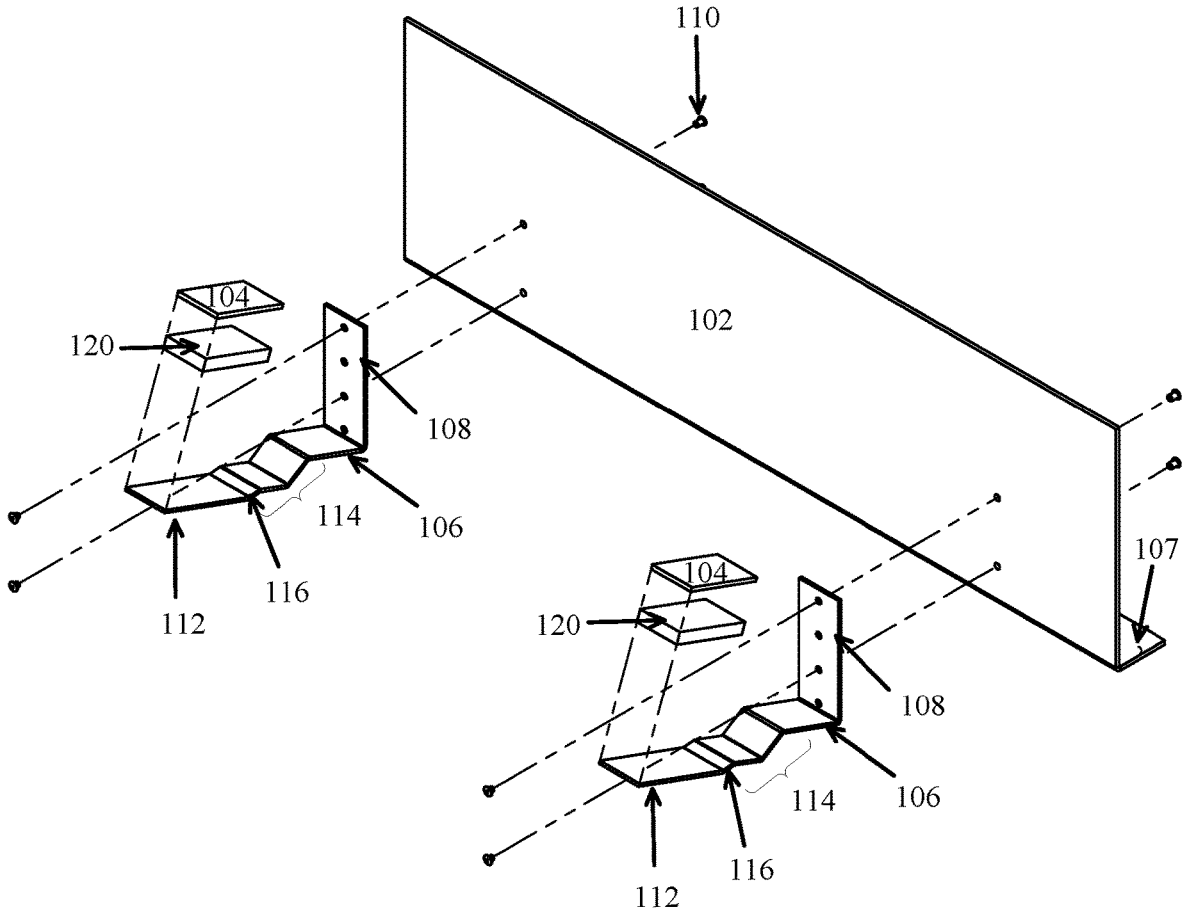

FIG. 5 illustrates and exploded view of FIG. 4. Non-skid pad 104 is depicted separated from cushion 120. Non-skid pad 104 may be composed of any surface that prevents the device from slipping out of the piano cabinet without damaging the surface of built-in sheet music holder 28. Cushion 120 may be composed of any material that allows it to conform to the shape of built-in sheet music holder 28. Arm mounting plate 108, arm 106, arm angle 114, arm bend 116, and foot 112 may be composed of aluminum, steel, tin, plastic, or any other material strong enough to support the weight of panel 100 of the Panel 100 of the Piano Footed Sheet Music Holder and shelf 107 may be composed of aluminum, steel, tin, plastic, or any other material strong enough to support the weight of sheet music.

Figure 6:
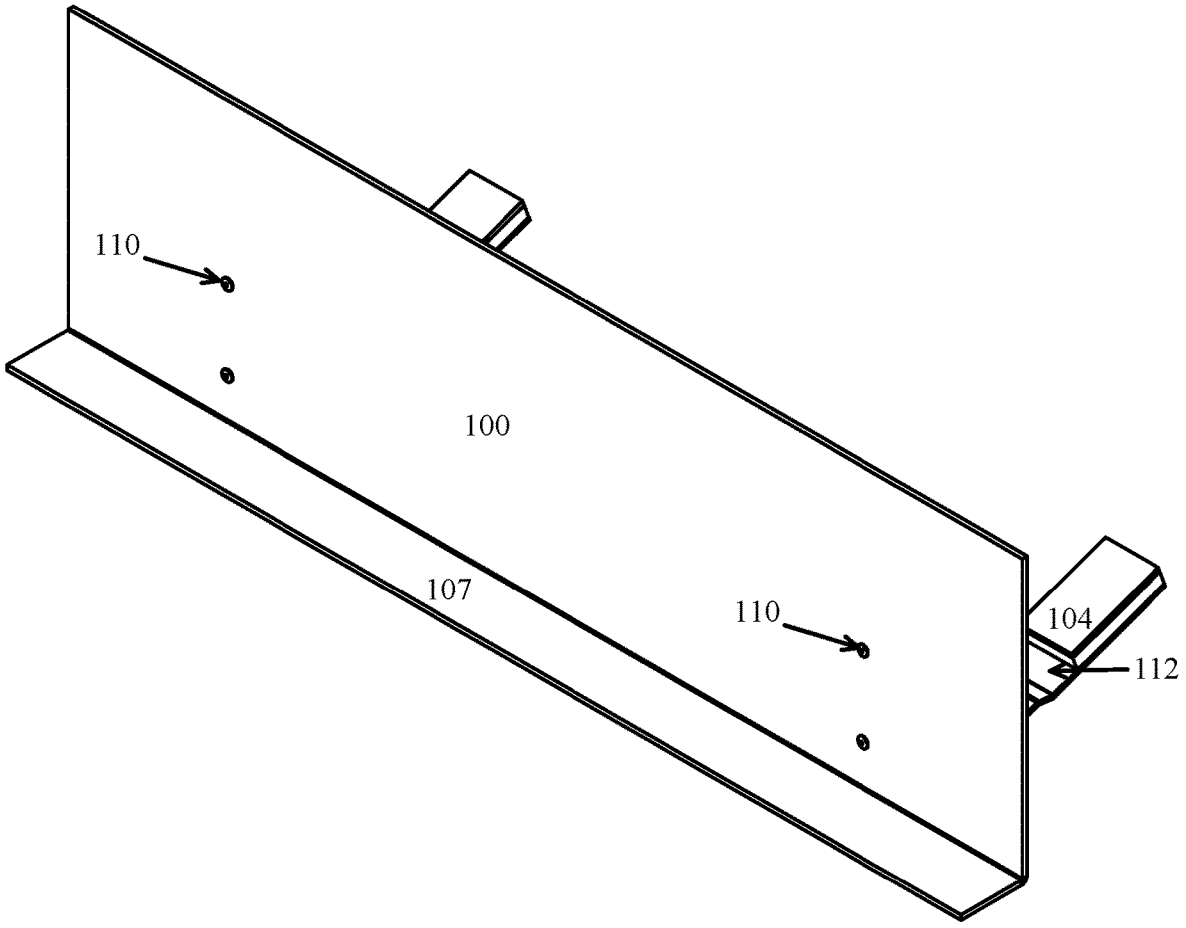
Figure 7:
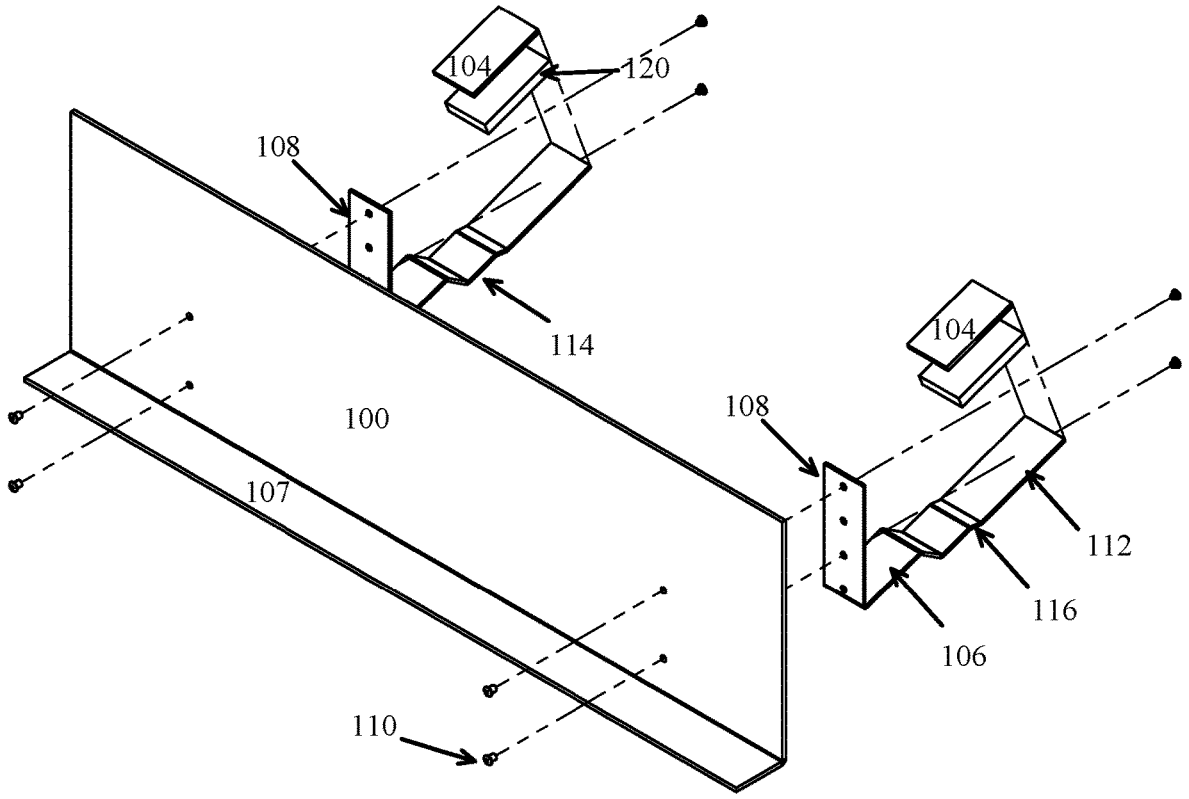

FIG. 6 illustrates a front view of the device. Mounting screws 110 are shown securing panel 100 of the Piano Footed Sheet Music Holder. Non-skid pad 104 is shown mounted onto foot 112. FIG. 7 is an exploded, front view of the device of FIG. 6 wherein the arm mounting plates 108 are detached from panel 100. Mounting screws 110 have been removed from arm mounting plate 108. Non-skid pad 104 is shown separated from cushion 120, which is separated from foot 112.

Figure 8:
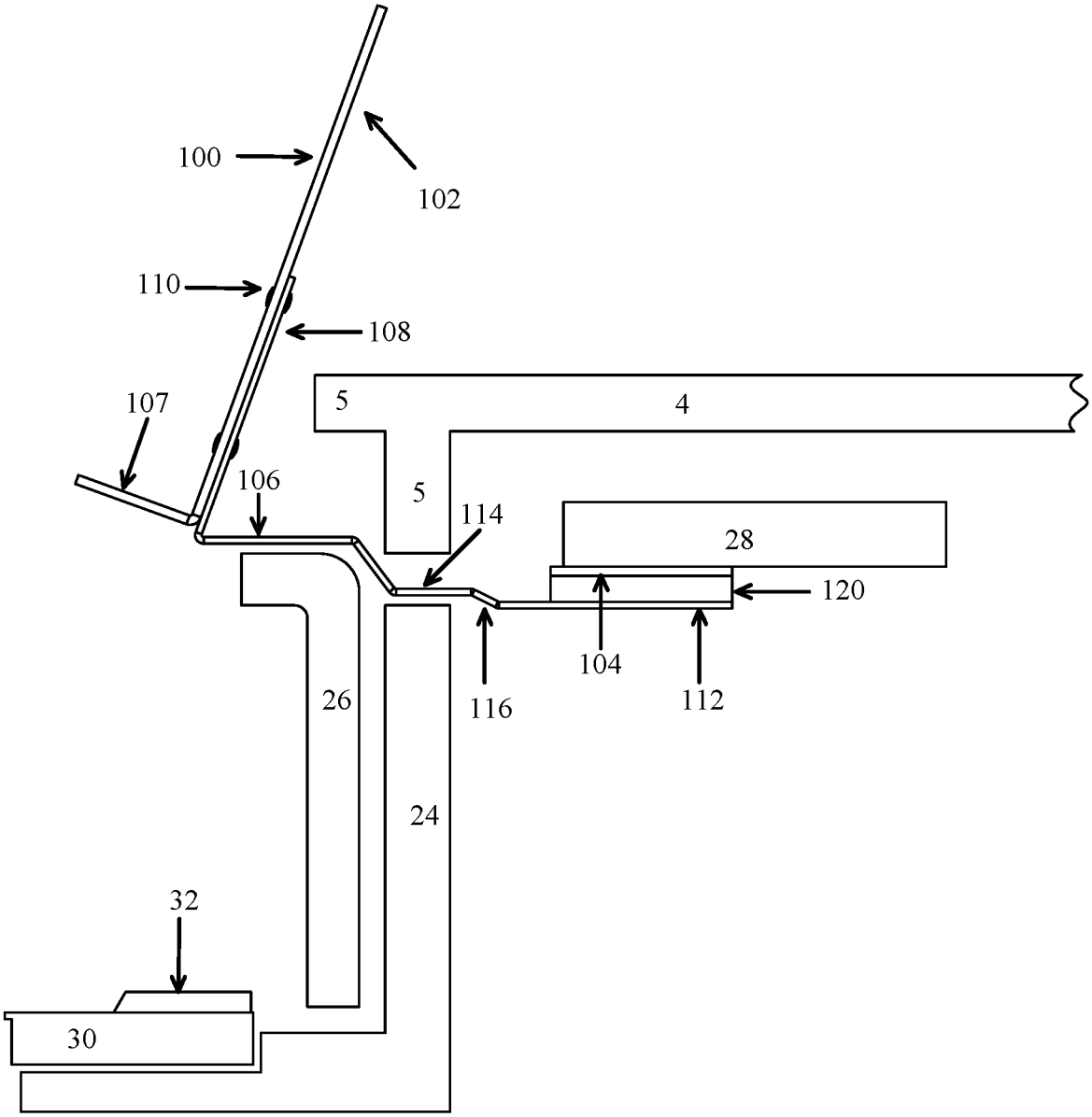

A mid-sectional view of the device installed upon a piano is shown in FIG. 8. Panel 100 is shown with mounting screws 110 securing mounting plate 108 to the rear surface 102 of panel 100. Shelf 107 is positioned to receive sheet music. Arm 106 rests upon fall board 26, which is raised so that it rest upon music stretcher board 24. Piano keys 30 and black keys 32 are accessible to a piano player. Arm angle 114 is conformed to fit below and around small lid 5. Arm bend 116 connects foot 112 to arm angle 114. Cushion 120 couples foot 112 to non-skid pad 104. Non-skid pad 104 presses up upon built in sheet music holder 28.

I hereby claim:

1. A piano sheet music holder comprising:

a shelf for holding sheet music;

at least one arm coupled to the shelf, wherein the arm is formed to rest upon a fall board of the piano when the fall board is open, wherein the arm is formed so that it extends beneath a piano lid, and wherein the arm is coupled to a foot; and a foot, wherein the foot is formed to extend beneath a built-in sheet music holder of the piano, and wherein the foot presses upward against the built-in sheet music holder.

2. The device of claim 1, wherein the arm is formed of aluminum, steel, or plastic.

3. The device of claim 1, wherein the foot further comprises a cushion coupled to the foot.

4. The device of claim 3, wherein the foot further comprises a non-skid surface coupled to the cushion.

5. The device of claim 1, wherein the foot is formed to extend beneath the music rack of the piano.

6. A method of coupling a sheet music holder to a piano comprising:

inserting an arm extending from the sheet music holder beneath the lid of the piano so that the arm extending from the sheet music holder rests on top of an opened fall board of the piano, inserting the arm extending from the sheet music holder beneath the lid of the piano so that the arm extending from the sheet music holder is positioned beneath a music rack or a built-in sheet music holder, and positioning a shelf of the sheet music holder so that the weight of said shelf is distributed to the arm extending from the sheet music holder.

7. A method of coupling a sheet music holder to a piano comprising:

cantilevering the weight of a shelf of the sheet music holder to an arm extending from the sheet music holder, wherein the arm extending from the sheet music holder is positioned beneath a piano lid so that the arm extending from the sheet music holder presses against a built-in sheet music holder of the piano.

* * * * *